US006717548B2

(12) United States Patent
Chen

(10) Patent No.: US 6,717,548 B2
(45) Date of Patent: Apr. 6, 2004

(54) DUAL- OR MULTI-FREQUENCY PLANAR INVERTED F-ANTENNA

(75) Inventor: I-Fong Chen, Tao-Yuan (TW)

(73) Assignee: Auden Techno Corp., Tao-Yuan Hsien (TW)

( * ) Notice: Subject to any disclaimer, the term of this patent is extended or adjusted under 35 U.S.C. 154(b) by 0 days.

(21) Appl. No.: 09/919,938

(22) Filed: Aug. 2, 2001

(65) Prior Publication Data

US 2003/0025636 A1 Feb. 6, 2003

(51) Int. Cl.[7] ..... H01Q 1/24; H01Q 1/36
(52) U.S. Cl. ..... 343/700 MS
(58) Field of Search ..... 343/700 MS, 846, 343/829, 830, 702; H01Q 1/24

(56) References Cited

U.S. PATENT DOCUMENTS 5,926,139 A * 7/1999 Korisch ..... 343/702
6,252,552 B1 * 6/2001 Tarvas et al. ..... 343/700 MS
6,343,208 B1 * 1/2002 Ying ..... 343/702
6,366,243 B1 * 4/2002 Isohatala et al. ..... 343/700 MS

* cited by examiner

*Primary Examiner*—Michael C. Wimer
(74) *Attorney, Agent, or Firm*—Troxell Law Office PLLC

(57) ABSTRACT

A dual- or multi-frequency planar inverted F-antenna, wherein, a metal surface of the antenna matching the size and shape of the interior installation space of an equipment is installed on the top of a grounding surface, an open slot provided on the metal surface forms a common close end and an open end to thereby partitions the metal surface into a long section and a short section; a desired impedance matching between a short point and a feed point of the metal surface is obtained by adjusting positions of the short point and the feed point in pursuance of frequencies desired; the length of the long section from the short point to the open end of the open slot and the length from the short point to the end point of the short section are decided by dual- or multi-resonance frequencies in cooperating with the open slot which is deformed and curved.

1 Claim, 5 Drawing Sheets

| 1: MKr (MHz) | | 2: MKr (MHz) dB |
|---|---|---|
| 1: 880.0000 | 2.415 | |
| 2: 960.0000 | 3.330 | |
| 3: 1710.0000 | 3.161 | |
| 4: 1880.0000 | 3.102 | |

DUAL- OR MULTI-FREQUENCY PLANAR INVERTED F-ANTENNA

BACKGROUND OF THE INVENTION

1. Field of the Invention

The present invention is related to a dual- or multi-frequency planar F-antenna, and especially to a planar antenna suitable for installing in different interior spaces on various equipment of dual- or multi-frequencies.

2. Description of the Prior Art

A spiral coil which is wound by metal wires is of the major type of antenna. Any of the followings including the diameter or the material of a coil or the pitch between rings of a coil or the total length of a coil of this kind of helix antenna will affect the set function. But the defect of such conventional helix antenna resides in three-dimensional protruding out of the equipment. As for communication equipment of the modern miniaturized type or with necessary built-in antennas (such as a mobile phone or a portable computer), it can hardly be surely desirable.

Thus, various miniaturized and planar microstrip antennas were gradually researched and developed. But in the early time, microstrip antennas such as those disclosed in U.S. Pat. Nos. 3,921,177 and 3,810,183 usually consisted of round or rectangular thin metal sheets. Dielectric substance is filled between the antenna and the ground. Generally speaking, this kind of microstrip antenna can go compatible only with narrower bandwidths. However, U.S. Pat. Ser. No. 07/695,686, abandoned, provides a polygonal spiral-type microstrip antenna which is an improvement on the early microstrip antennas; its bandwidth is close to that of a general helix antenna of constant impedance. But the defect of this kind of microstrip antenna is that, for low frequencies, the diameter of the antenna becomes quite large and is not suitable for modern portable communication equipment.

Among the modern applicable embodiments of the planar antennas, the relatively more notable one is the kind of planar inverted F-antenna (PIFA). The structure of such a planar inverted F-antenna, as shown in FIG. 1, comprises a metal wire 11 provided on a grounding surface 10, a short point 12 is provided on one end of the metal wire 11 and a feed point 13 is provided near the short point 12, the feed point 13 is connected to a feed-in axle 14. In this way, a desired single-frequency antenna is formed. This early type of inverted F-antenna can be developed to get a planar inverted F-antenna as shown in FIG. 2. Basically it includes a metal surface 15 of a predetermined area, and other related items including a grounding surface 100, a short point 120, a feed point 130 and a feed-in axle 140.

It was stated in "Dual-Frequency PIFA" on page 1451 of "IEEE" published in October of 1997 that, either to merge two separate blocks of different sizes into a rectangular shape or to provide an open slot with two mutually perpendicular sections on a rectangular metal surface can form a desired dual frequency PIFA. But the problem is that different mode mobile phones of different brands include slightly different operating frequencies and various interior installation spaces for antennas. Obviously, the art supplied in the abovementioned document is unable to solve thoroughly the problem of installing these dual- or multi-frequency PIFA in mobile phones of different brands.

SUMMARY OF THE INVENTION

The object of the present invention is to provide a dual- or multi-frequency PIFA; the device can match various interior installation spaces of communication equipment, and becomes a proper built-in planar dual- or multi-frequency PIFA.

To achieve the object, the metal surface on the top of the grounding surface of this invention is partitioned into a long and a short section of different sizes by a deformed and curved open slot, of which the short point and the feed point can be adjusted properly. The length from the short point to the end point of the short section and the length on the long section from the short point to the open end of the open slot are decided by the resonance frequencies of themselves.

The present invention will be apparent in its novelty and other features after reading the detailed description of the preferred embodiment thereof in reference to the accompanying drawings.

DETAILED DESCRIPTION OF THE PREFERRED EMBODIMENT

Figure 1:
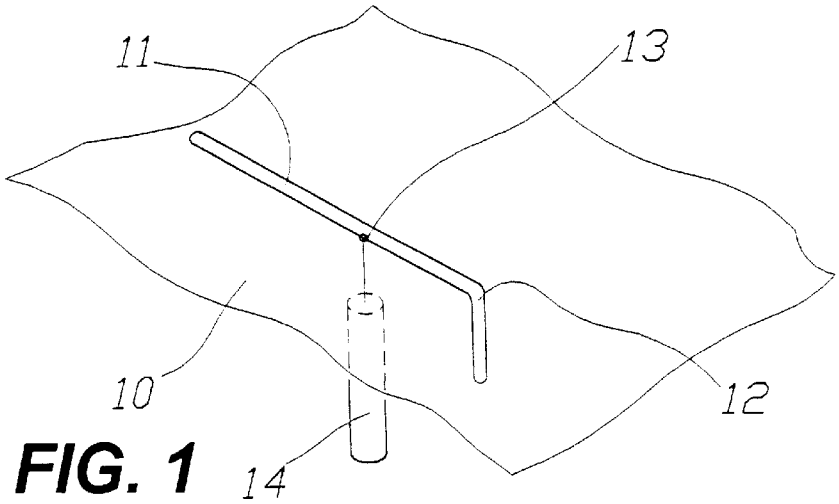
FIG. 1 PRIOR ART
FIG. 1 is a perspective view of a conventional single frequency inverted F-antenna.
Figure 2:
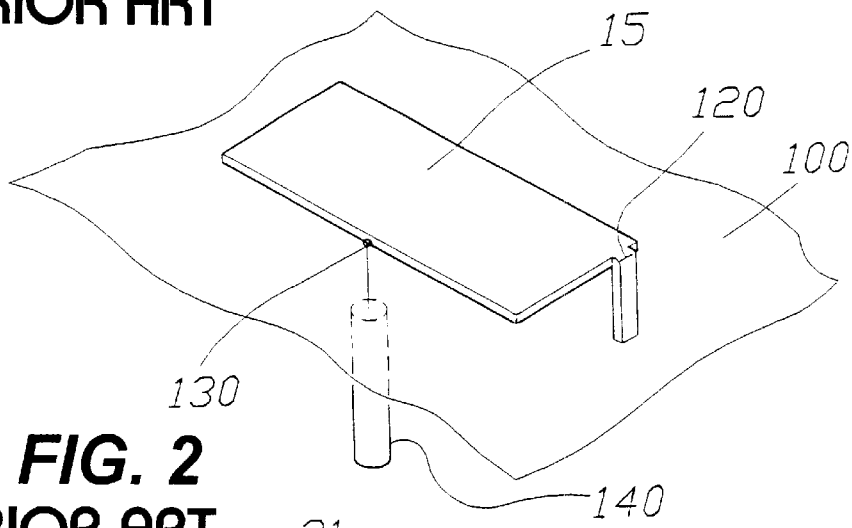
FIG. 2 PRIOR ART
FIG. 2 is a perspective view of a conventional single frequency planar inverted F-antenna.
Figure 3:
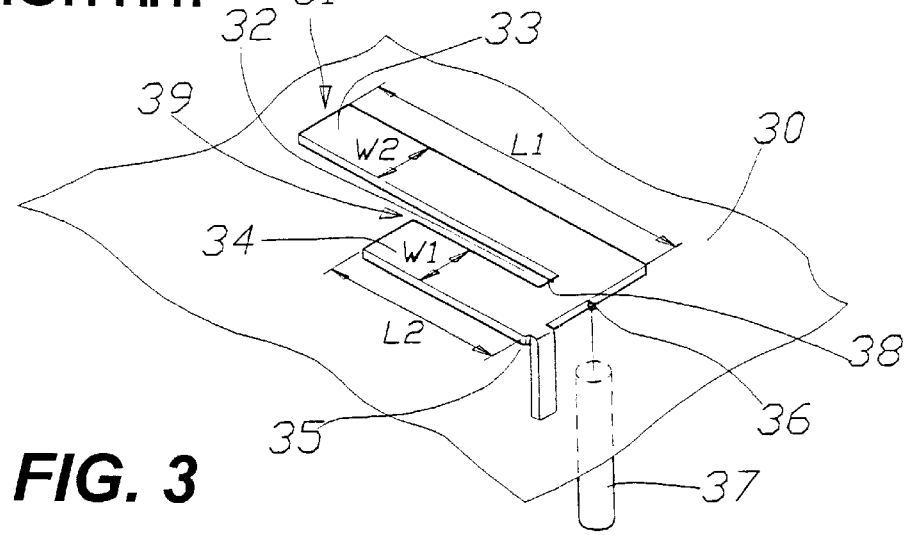
FIG. 3 is a perspective view of the basic structure of the present invention.

Referring to FIG. 3 firstly, according to the theory of PIFA mentioned previously, a metal surface 31 can be installed on a grounding surface 30 in the present invention. An open slot 32 on the metal surface 31 partitions the latter into a long section 33 and a short section 34. A short point 35, a feed point 36 and a feed-in axle 37 on the metal surface 31 are chosen separately. The open slot 32 has a common close end 38 connecting the long section 33 and the short section 34 and has an open end 39.

Basically, the length $L_1$ and $L_2$ of the long section 33 and the short section 34 respectively are both $\lambda/4$ of their resonance frequencies (such as 900 MHz and 1800 MHz), 50Ω impedance matching can be obtained by adjusting the positions of the feed point 36 and the short point 35. The width $W_1$ and $W_2$ of the long section 33 and the short section 34 respectively are the factors deciding the gain of the antenna.

Figure 4:
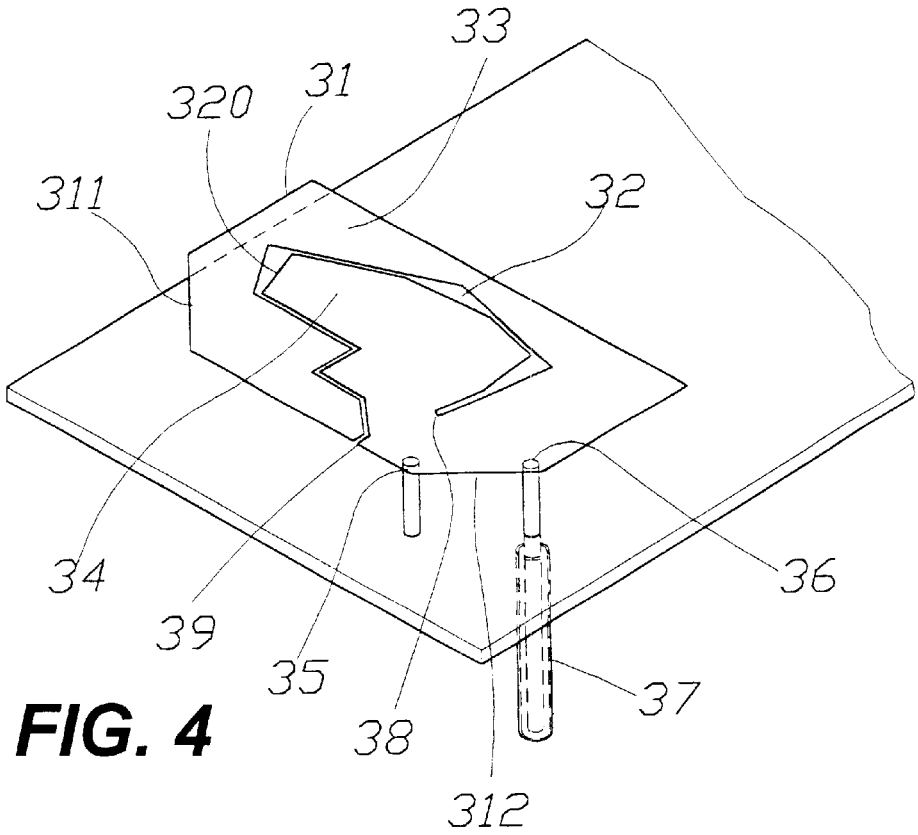
FIG. 4 is a perspective view of a practicable embodiment of the present invention.
Figure 5:
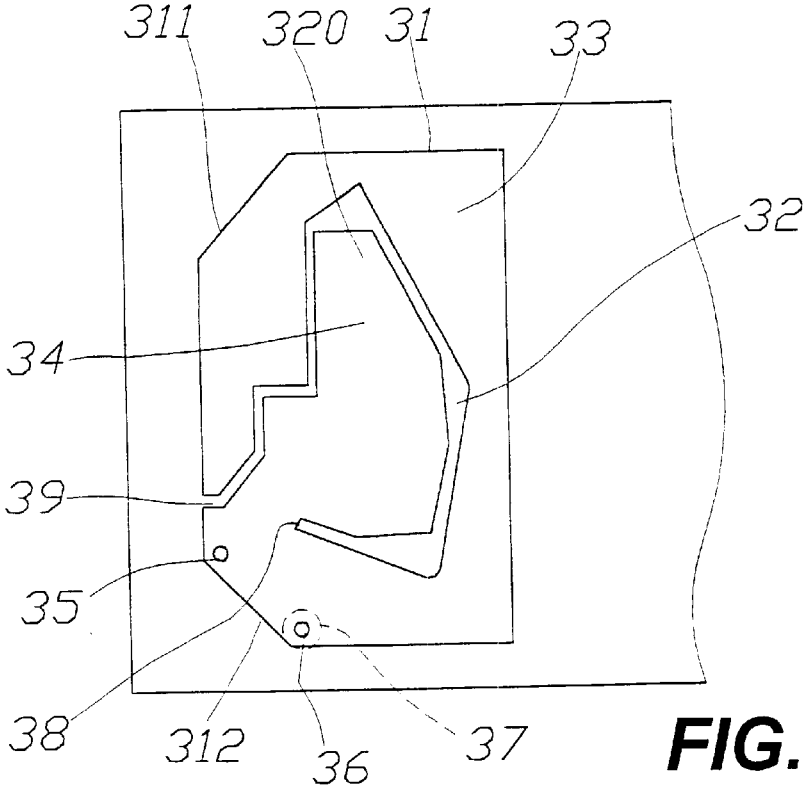
FIG. 5 is a plane view taken from FIG. 4.

For example, when in installation in the interior of a mobile phone, since different brands accommodate different interior installation spaces, and the width of the spaces are generally smaller than the length of the long section 33, the present invention provides the practicable embodiment as shown in FIGS. 4, 5.

Referring to FIGS. 4, 5, the metal surface 31 of the present invention can be compatible with the area and the shape of an installation environment, the embodiment as shown on the figures that includes the cut angle portions 311, 312 can dodge the interior elements of a mobile phone. The deformed and curved open slot 32 constitutes a short section 34 as an inner zone and a long section 33 as an outer zone. The open slot 32 makes the close end 38 fixed at a proper location of the metal surface 31, and the open end 39 is opened at one side of the metal surface 31. In such structure, a test of moving and adjusting for obtaining the positions of the short point 35 and the feed point 36 can be done.

The prime feature of the present invention is that the length from the short point 35 to the open end 39 of the long section 33 of the outer zone and the length from the short point 35 to the end point 320 of the short section 34 of the inner zone are decided by $\lambda/4$ of the dual- or multi-resonance frequency. In other words, no matter what shape of the metal surface 31 in pursuance of various locations of installation is, the suitable dual- or multi-frequency PIFA for the interior of the communication equipment can be obtained by means of the deformed and curved open slot 32.

The height between the metal surface 31 and the grounding surface 30 of the PIFA had better be $0.04\lambda$, and no less than $0.04\lambda$, in order to avoid that the band width gets narrower.

Figure 6:
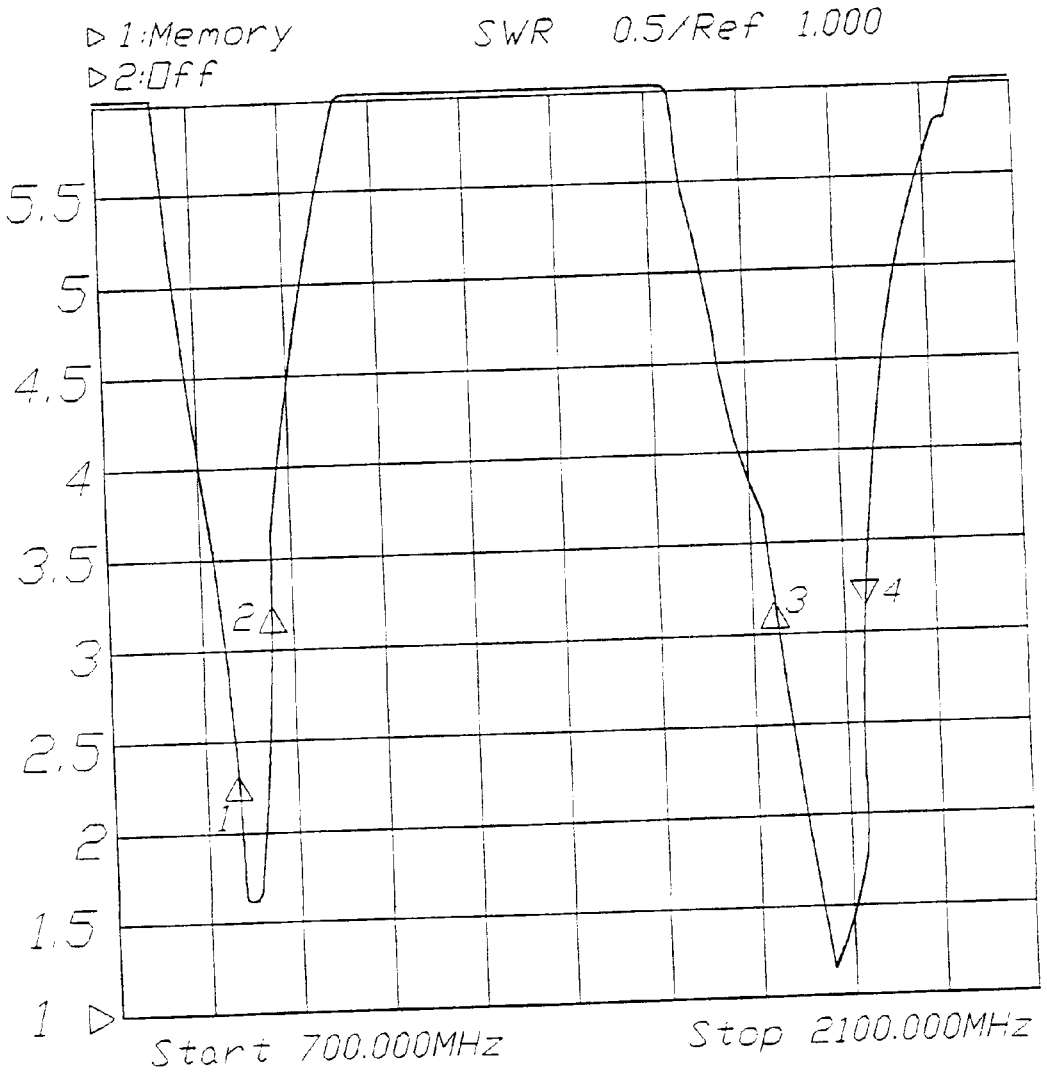
FIG. 6 is a testing chart of the embodiment of FIGS. 4, 5.
Figure 7:
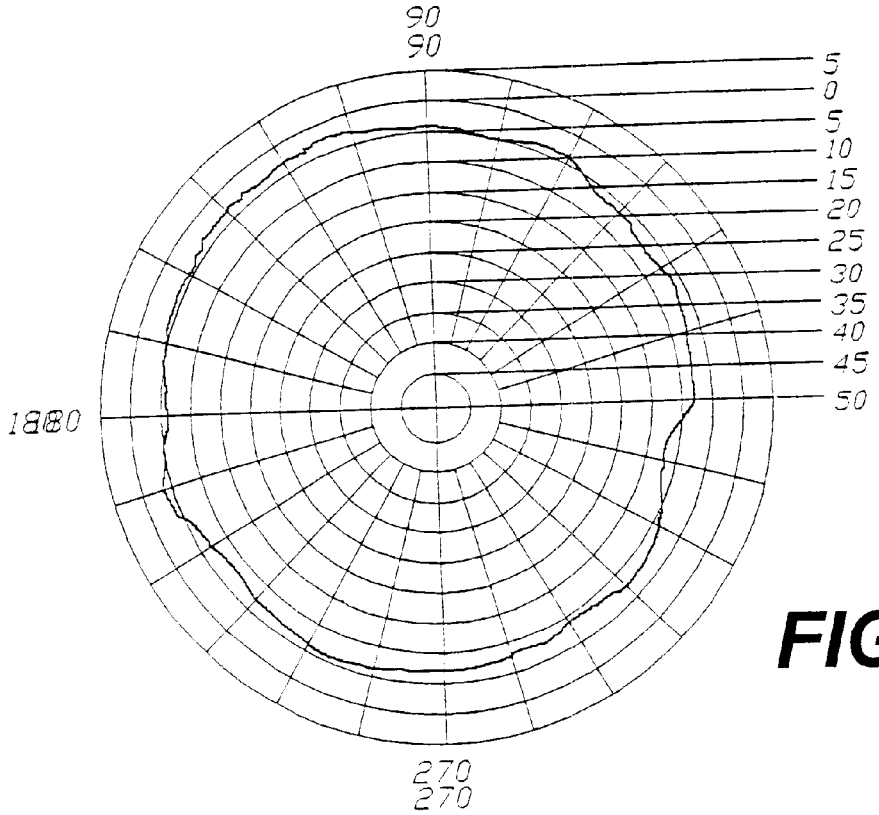
FIGS. 7–10 are testing charts of electromagnetic radiation fields of the embodiment of the present invention.
Figure 8:
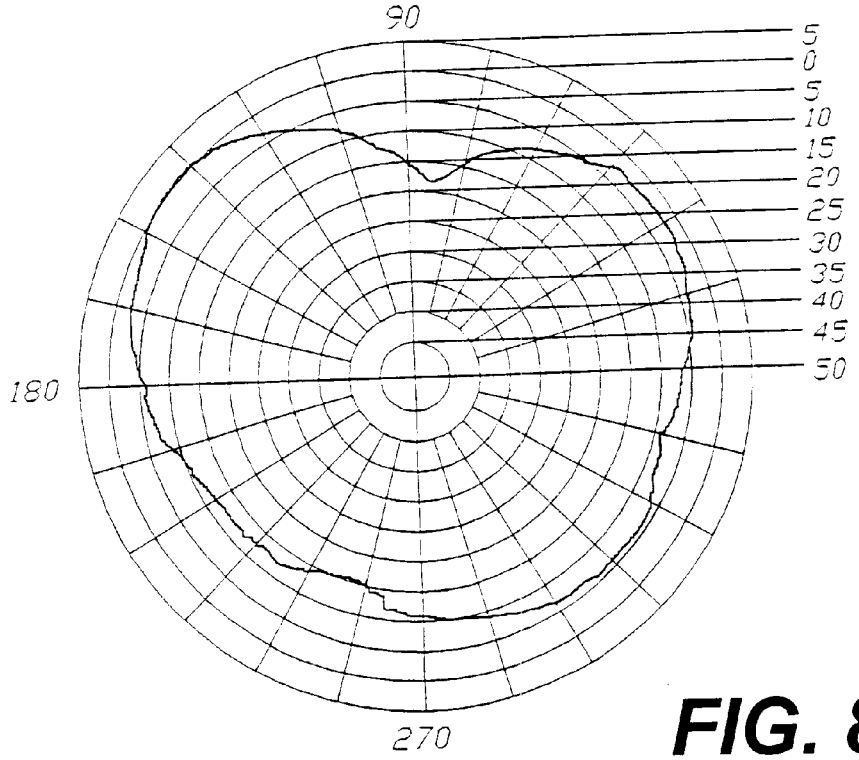
Figure 9:
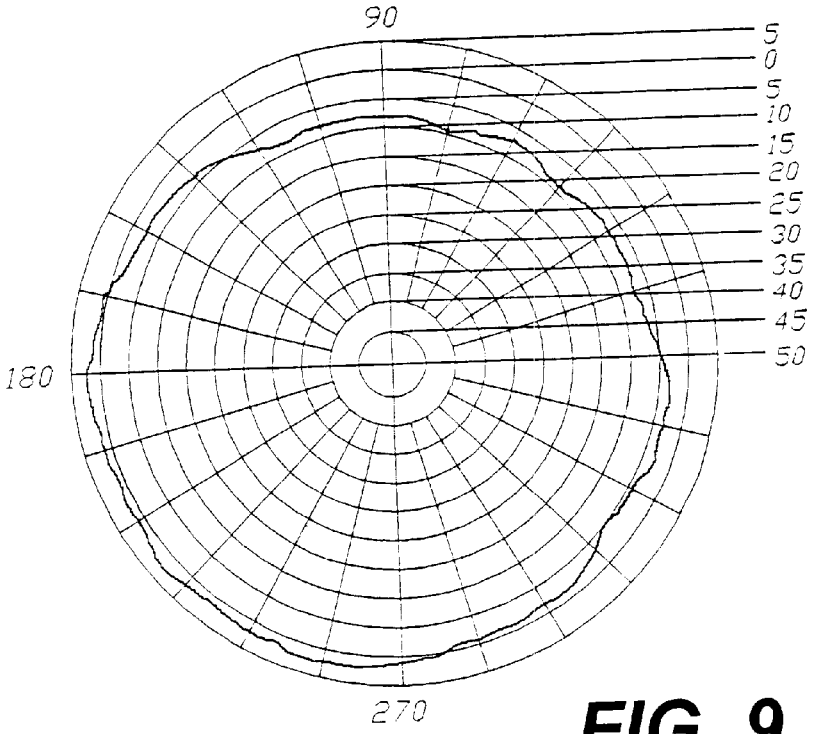
Figure 10:
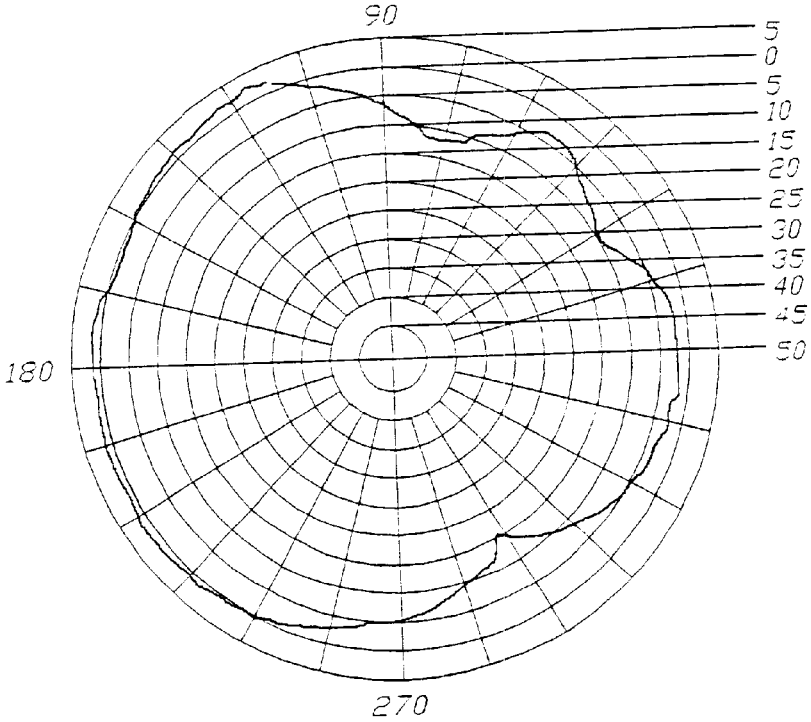

In testing the dual-frequency PIFA of the above-mentioned structure of the present invention, as shown in FIG. 6, the standing wave ratio (VSWR) for the frequency 880 MHz (Point 1) is 2.415, the VSWR for the frequency 960 MHz (Point 2) is 3.33, the VSWR for the frequency of 1710 MHz (Point 3) is 3.161, and for Point 4 (1880 MHz) 3.102. Under the built-in mode, the VSWR between 2.415–3.33 is quite ideal.

For the electromagnetic radiation field of the present invention as shown in 7–10, the maximum antenna gains of the E-plane and the H-plane at 925 MHz are respectively 0.7 and −2.15 dBi; and the maximum antenna gains are respectively 1.64 and 2.29 dBi at 1800 MHz. The present invention is surely practicable.

This kind of planar antenna of the present invention thus can suit various frequencies and interior installation spaces of various brands. The present invention thereby is industrially valuable.

Having thus described my invention, what I claim as new and desire to be secured by Letters Patent of the United States are:

1. A dual or multi-frequency planar inverted F-antenna comprising:

a) a metal surface including:
   i) a long antenna section having an outer boundary edge;
   ii) a short antenna section located within the outer boundary edge of the long antenna section, the short antenna section connected to the long antenna section by a connection section, the short antenna section having an end point spaced from the connection section; and,
   iii) a single slot separating the short antenna section from the long antenna section except for the connection section, the single slot including an open end at the outer boundary edge and a closed end, the slot having a non-uniform width and oriented such that the connection section is bounded on opposite sides by the closed end of the slot and a portion of the slot adjacent to the open end;

b) a feed point on the long antenna section; and, c) a short point on the long antenna section spaced from the feed point, distances between the short point and the open end of the slot, and between the short point and the end point of the short antenna section are $\lambda/4$ of respective resonance frequencies.

* * * * *